US011660884B2

(12) United States Patent
Mikashima

(10) Patent No.: US 11,660,884 B2
(45) Date of Patent: May 30, 2023

(54) IMAGE FORMING APPARATUS

(71) Applicant: KYOCERA Document Solutions Inc., Osaka (JP)

(72) Inventor: Katsuo Mikashima, Osaka (JP)

(73) Assignee: Kyocera Document Solutions, Inc.

( * ) Notice: Subject to any disclaimer, the term of this patent is extended or adjusted under 35 U.S.C. 154(b) by 0 days.

(21) Appl. No.: 17/574,954

(22) Filed: Jan. 13, 2022

(65) Prior Publication Data

US 2022/0227144 A1 Jul. 21, 2022

(30) Foreign Application Priority Data

Jan. 21, 2021 (JP) ..... JP2021-008157

(51) Int. Cl.

| | |
|---|---|
| ***B41J 11/00*** | (2006.01) |
| ***B41J 2/165*** | (2006.01) |
| ***B41J 2/045*** | (2006.01) |
| ***B41J 11/42*** | (2006.01) |

(52) U.S. Cl.

CPC ..... *B41J 11/007* (2013.01); *B41J 2/04573* (2013.01); *B41J 2/04598* (2013.01); *B41J 11/42* (2013.01)

(58) Field of Classification Search

CPC .... B41J 11/007; B41J 2/04598; B41J 2/1707; B41J 2/1721; B41J 29/38

See application file for complete search history.

(56) References Cited

U.S. PATENT DOCUMENTS

| | | | | |
|---|---|---|---|---|
| 2005/0253920 | A1 | 11/2005 | Yoshimizu | |
| 2011/0316923 | A1* | 12/2011 | Izumikawa | B41J 11/485 347/16 |
| 2021/0155001 | A1* | 5/2021 | Yamashita | B41J 2/1721 |

FOREIGN PATENT DOCUMENTS

| | | | |
|---|---|---|---|
| JP | 2003-276906 | | 10/2003 |
| JP | 2005-319739 | | 11/2005 |
| JP | 2006-193247 | | 7/2006 |
| JP | 2021084234 A | * | 6/2021 |

OTHER PUBLICATIONS

Okada, MachineTranslationofJP-2021084234-A, 2021 (Year: 2021).*

* cited by examiner

*Primary Examiner* — Scott A Richmond

(57) ABSTRACT

An image forming apparatus includes a transportation belt, a print engine, and an ejection timing control unit. The transportation belt transports a print sheet. The print engine ejects ink onto the print sheet. The ejection timing control unit adjusts an ink ejection timing of the print engine. The transportation belt includes a flushing opening part. The print engine repeatedly performs ink flushing to the flushing opening part at predetermined timings. Further the ejection timing control unit derives an adjustment amount for the ink ejection timing of the print engine on the basis of: a number of the ink ejection timings in a period from a previous flushing time to a current flushing time, a distance from the flushing opening part for the flushing at the previous flushing time to the flushing opening part for the flushing at the current flushing time, and a print resolution.

4 Claims, 7 Drawing Sheets

IMAGE FORMING APPARATUS

CROSS-REFERENCE TO RELATED APPLICATIONS

This application relates to and claims priority rights from Japanese Patent Application No. 2021-008157, filed on Jan. 21, 2021, the entire disclosures of which are hereby incorporated by reference herein.

BACKGROUND

1. Field of the Present Disclosure

The present disclosure relates to an image forming apparatus.

2. Description of the Related Art

An image forming apparatus measures a transportation movement amount using a rotary encoder that detects rotation of a motor or a roller for transporting a recording paper sheet, and/or a linear encoder that measures a movement amount of a transportation belt, adjusts the transportation movement amount such that the transportation movement amount of a recording paper sheet gets the same as a reference value, and ejects ink to a proper position and thereby forms an image.

However, in order to accurately adjust the aforementioned transportation movement amount, it is required to install plural encoders or a high resolution encoder, and consequently, it results in a high cost of the apparatus. Further, when a rotary encoder is used to detect rotation of the motor or the roller, a transportation speed of the paper sheet may not be accurately detected, even if the rotary encoder is a high resolution rotary encoder, because a speed of the transportation belt fluctuates due to some causes in a driving system from the motor or the roller to the transportation belt (e.g. a bearing of the motor or the roller, a deflection of the belt, and/or the like). Furthermore, on a measurement value of the transportation speed, an error due to the speed fluctuation of the transportation belt induced by the driving system from the motor or the roller to the transportation belt is not detected and accumulated, and therefore, an error on an ink ejection timing may get large over time and result in a low image quality.

SUMMARY

An image forming apparatus according to an aspect of the present disclosure includes a transportation belt, a print engine, and an ejection timing control unit. The transportation belt is configured to transport a print sheet. The print engine is configured to eject ink onto the print sheet. The ejection timing control unit is configured to adjust an ink ejection timing of the print engine. The transportation belt includes a flushing opening part. The print engine repeatedly performs ink flushing to the flushing opening part at predetermined timings. Further the ejection timing control unit derives an adjustment amount for the ink ejection timing of the print engine on the basis of: a number of the ink ejection timings in a period from a previous flushing time to a current flushing time, a distance from the flushing opening part for the flushing at the previous flushing time to the flushing opening part for the flushing at the current flushing time, and a print resolution.

These and other objects, features and advantages of the present disclosure will become more apparent upon reading of the following detailed description along with the accompanied drawings.

DETAILED DESCRIPTION

Hereinafter, embodiments according to an aspect of the present disclosure will be explained with reference to drawings.

Embodiment 1

Figure 1:
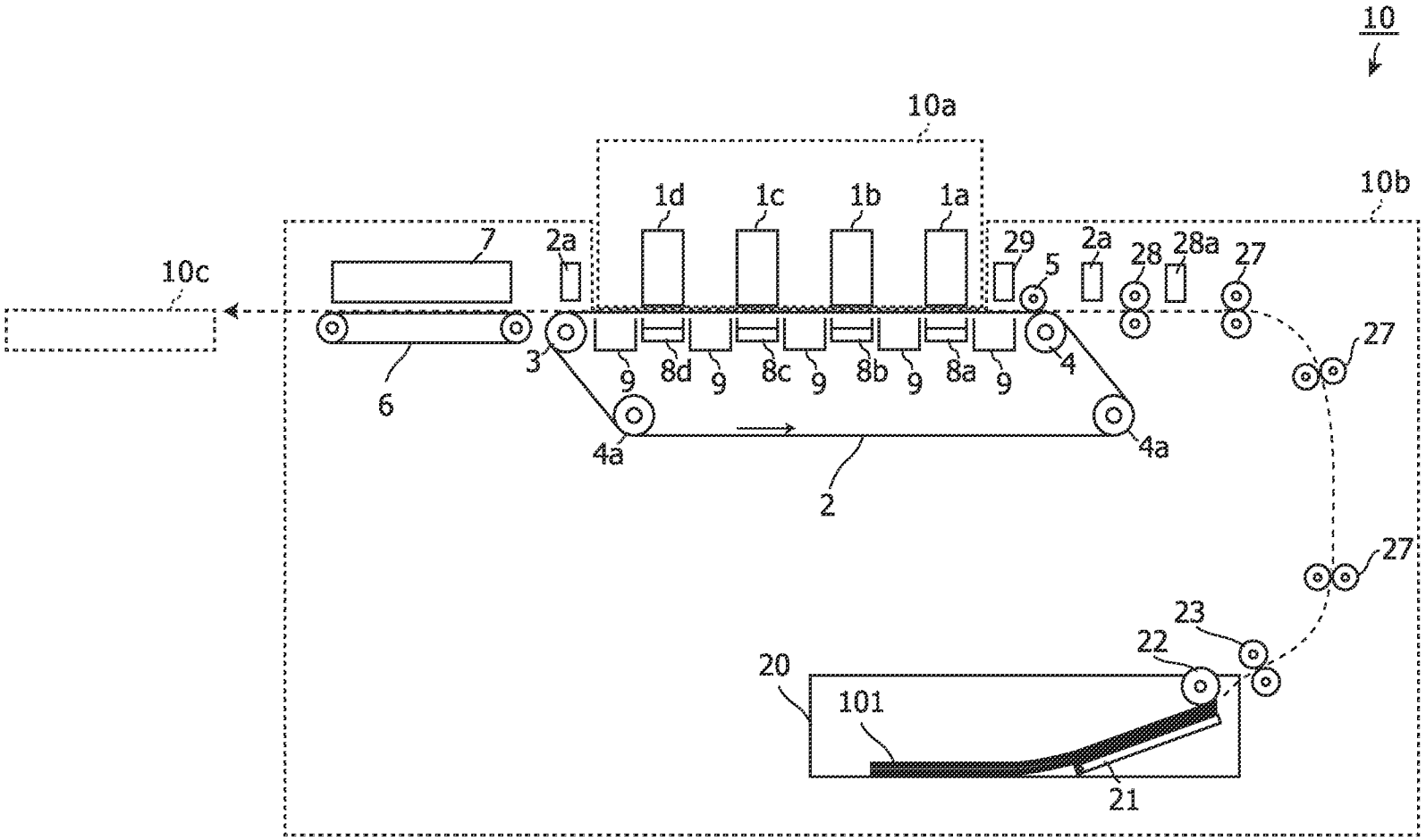
FIG. 1 shows a side view that indicates an internal mechanical configuration of an image forming apparatus in an embodiment according to the present disclosure.
Figure 2:
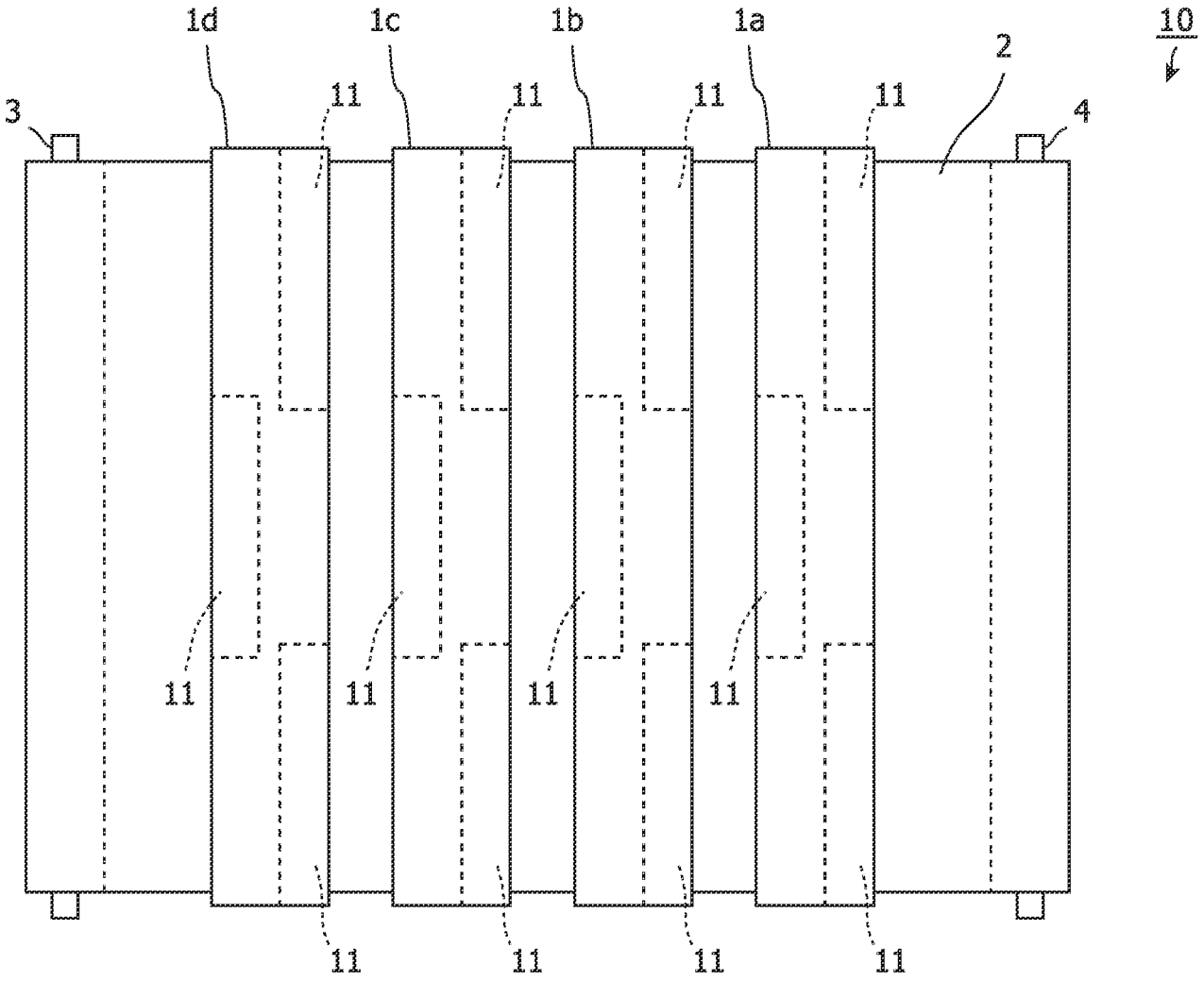
FIG. 2 shows a plane view of the image forming apparatus shown in FIG. 1.

FIG. 1 shows a side view that indicates an internal mechanical configuration of an image forming apparatus in an embodiment according to the present disclosure. FIG. 2 shows a plane view of the image forming apparatus shown in FIG. 1.

The image forming apparatus 10 in this embodiment is an apparatus such as printer, copier, facsimile machine or multi function peripheral, and in this embodiment, includes an inkjet color printing mechanism of a line head type.

The image forming apparatus 10 shown in FIG. 1 includes a print engine 10*a* and a sheet transportation unit 10*b*. The print engine 10*a* physically prints an image to be printed on a print sheet (print paper sheet or the like). An ink cartridge is enabled to be mounted and demounted to and from the print engine 10*a*, and the print engine 10*a* performs printing using ink supplied from the ink cartridge. The sheet transportation unit 10*b* transports the print sheet to the print engine 10*a*.

In this embodiment, the print engine 10*a* includes line-head-type inkjet recording units 1*a* to 1*d* corresponding to four ink colors: Cyan, Magenta, Yellow, and Black, and ejects ink onto the print sheet using the inkjet recording units 1*a* to 1*d*.

As shown in FIG. 2, in this embodiment, each of the inkjet recording units 1*a* to 1*d* includes a single or plural (here, three) head units 11. The head units 11 are arranged along a primary scanning direction, and are capable of being mounted to and demounted from a main body of the image forming apparatus.

Further, in this embodiment, the sheet transportation unit 10*b* includes (a) a circular-type transportation belt 2 that is arranged so as to be opposite to the print engine 10*a* and transports a print sheet, (b) a driving roller 3, a driven roller 4, and a tension roller 4*a* around which the transportation belt 2 is hitched, (c) a nipping roller 5 that nips the print sheet with the transportation belt 2, (d) a post-stage transportation belt 6, and (e) a dryer 7.

The driving roller 3, the driven roller 4, and the tension roller 4*a* cause the transportation belt 2 to rotate. The nipping roller 5 nips an incoming print sheet transported from a sheet feeding cassette 20 mentioned below, and the nipped print sheet is transported by the transportation belt 2 to printing positions of the inkjet recording units 1*a* to 1*d* in turn, and on the print sheet, images of respective colors are printed by the inkjet recording units 1*a* to 1*d*. In this situation, the passing print sheet is detected by a sheet sensor 2*a*, and a current position of the print sheet on a transportation path is determined on the basis of a detection timing by the sheet sensor 2*a*, and thereby an image is printed at a proper position on the print sheet. Subsequently, the print sheet after printing is outputted by the post-stage transportation belt 6 to an output tray 10*c* or the like. In this process, the dryer 7 dries the print sheet on which the ink has been ejected.

Figure 3:
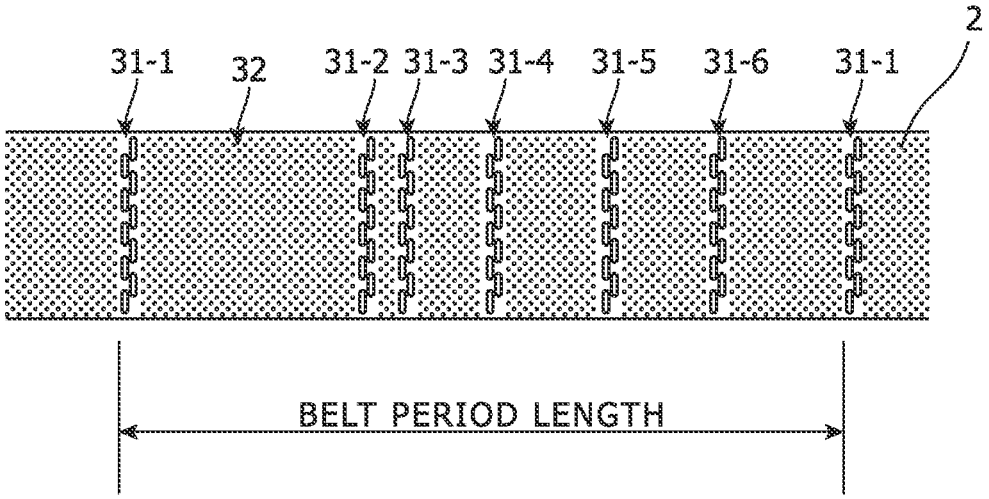
FIG. 3 shows a diagram that indicates an example of a transportation belt 2 shown in FIG. 1.

FIG. 3 shows a diagram that indicates an example of a transportation belt 2 shown in FIG. 1.

The transportation belt 2 includes flushing opening parts 31-1 to 31-M (here, M=6). For example, as shown in FIG. 3, a single or plural flushing opening parts 31-1 to 31-M is/are formed in the transportation belt 2, and each flushing opening part 31-*i* (i=1, . . . , M) is formed along a primary scanning direction. Further, sheet suction holes 32 are substantially uniformly arranged at a predetermined density in an area (whole area) other than the flushing opening parts 31-1 to 31-M.

For example, as shown in FIG. 1, ink receiver units 8*a* to 8*d* are installed under the head units 11 of the inkjet recording units 1*a* to 1*d*. Ink flushing (line flushing) of each inkjet recording unit 1*a*, 1*b*, 1*c*, or 1*d* is performed when any flushing opening part 31-*i* is located at a position right under the head unit 11 of the inkjet recording unit 1*a*, 1*b*, 1*c*, or 1*d*; and ink is ejected in line from the head unit 11 for the flushing, and passes through the flushing opening part 31-*i*; and the ink is received by the corresponding ink receiver unit 8*a*, 8*b*, 8*c*, or 8*d* and thereafter corrected to a waste ink tank.

Further, sheet suction units 9 are arranged along the transportation path of the print sheet in parts other than the ink received units 8*a* to 8*d*. A negative pressure is applied to the sheet suction units 9, and thereby the print sheet is adsorbed to the transportation belt 2. It should be noted that a lower negative pressure is applied to the ink receiver units 8*a* to 8*d*, than that applied to the sheet suction units 9.

Further the sheet transportation unit 10*b* includes a sheet feeding cassette 20 as a sheet supply source. The sheet feeding cassette 20 stores print sheets 101, and pushes up the print sheets 101 using a lift plate 21 so as to cause the print sheets 101 to contact with a pickup roller 22. The print sheets 101 put on the sheet feeding cassette 20 are picked up to a sheet feeding roller 23 by the pickup roller 22 sheet by sheet from the upper side. The sheet feeding roller 23 is a roller that transports the print sheets 101 sheet by sheet fed by the pickup roller 22 from the sheet feeding cassette 20 onto a transportation path.

A transportation roller 27 is a roller to transport the print sheet 101 on the transportation path. A registration roller 28 temporarily stops the print sheet 101 when the incoming print sheet 101 in transportation is detected by a registration sensor 28*a*, and transports this print sheet 101 to the print engine 10*a* (specifically, to a nipping position of the nipping roller 5 and the transportation belt 2) at a secondary sheet feeding timing. The secondary sheet feeding timing is specified by a control unit 81 mentioned below such that an image is formed at a position specified on the print sheet 101.

Figure 4:
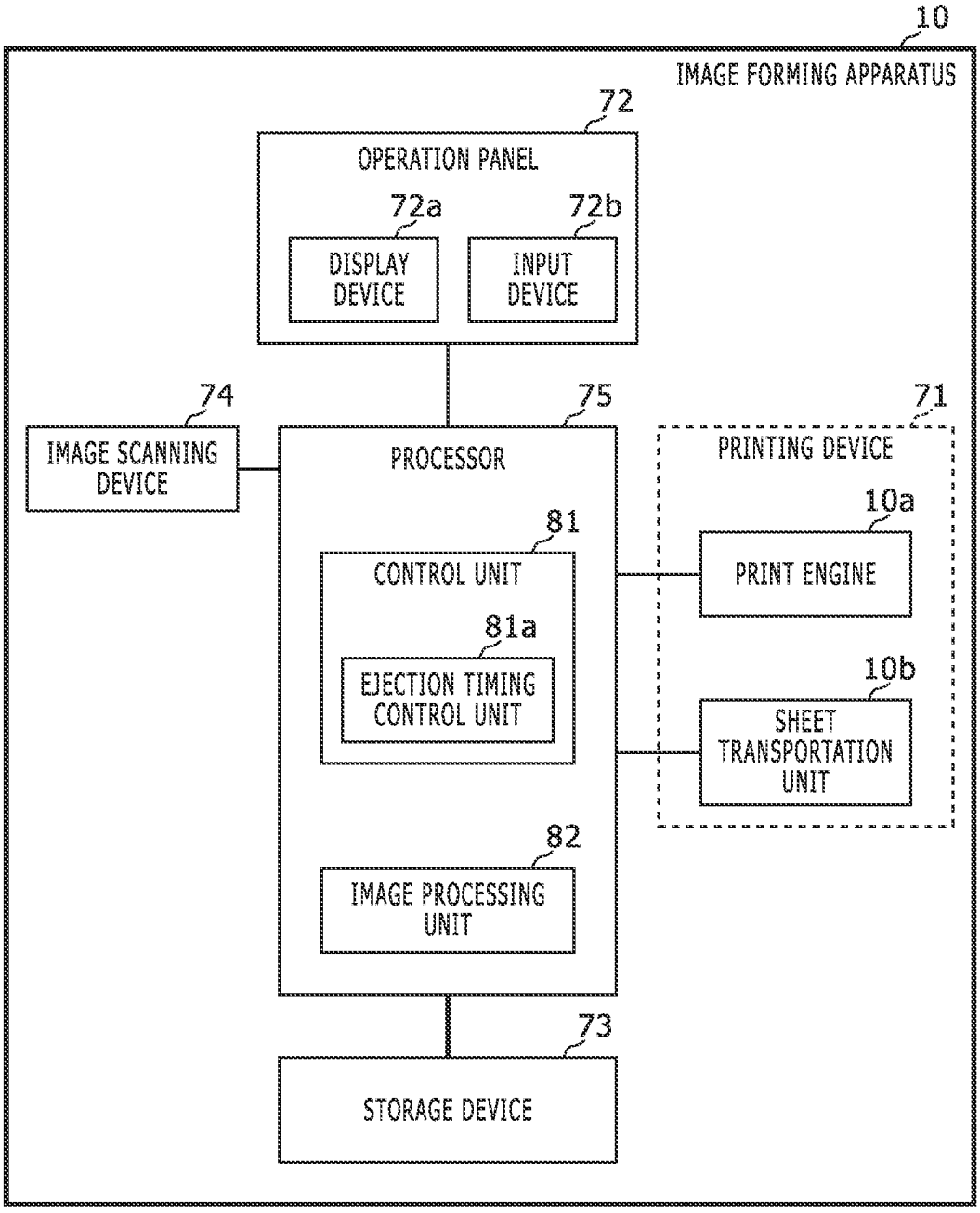
FIG. 4 shows a block diagram that indicates an electronic configuration of the image forming apparatus 10 in the embodiment according to the present disclosure.

FIG. 4 shows a block diagram that indicates an electronic configuration of the image forming apparatus 10 in the embodiment according to the present disclosure. As shown in FIG. 4, the image forming apparatus 10 includes not only a printing device 71 that includes the mechanical configuration shown in FIGS. 1 and 2 but an operation panel 72, a storage device 73, a communication device 74, and a processor 75.

The operation panel 72 is arranged on a housing surface of the image forming apparatus 10, and includes a display device 72*a* such as a liquid crystal display and an input device 72*b* such as a hard key and/or touch panel, and displays sorts of messages for a user using the display device 72*a* and receives a user operation using the input device 72*b*.

The storage device 73 is a non-volatile storage device (flash memory, hard disk drive or the like) in which data, a program and the like for controlling the image forming apparatus 10 have been stored.

The image scanning device 74 includes a platen glass and an auto document feeder, and optically scans a document image from a document put on the platen glass or a document fed by the auto document feeder, and generates image data of the document image.

The processor 75 includes a computer that operates in accordance with a program, an ASIC (Application Specific Integrated Circuit) that performs a predetermined action, and/or the like, and acts as sorts of processing units using the computer, the ASIC and/or the like. This computer includes a CPU (Central Processing Unit), a ROM (Read Only Memory), a RAM (Random Access Memory) and the like, and loads a program stored in the storage device 73, the ROM or the like to the RAM and executes the program using the CPU and thereby acts as processing units (with the ASIC if required).

Here the processor 75 acts as a control unit 81 and an image processing unit 82.

The control unit 81 controls the printing device 71 (the print engine 10*a*, the sheet transportation unit 10*b* and the like), and thereby performs a print job requested by a user. In this embodiment, the control unit 81 causes the image processing unit 82 to perform a predetermined image process, and controls the print engine 10*a* (the head units 11) and causes the head units 11 to eject ink and thereby forms a printing image on a print sheet. The image processing unit 82 performs a predetermined image process such as RIP (Raster Image Processing), color conversion, halftoning and/or the like for image data of an image to be printed.

The control unit 81 causes the printing device 71 to print an image specified by a user. Specifically, the control unit 81 causes the print engine 10*a* to print a user document image based on printing image data specified by a user.

The control unit 81 causes the print engine 10*a* to eject ink when printing the user document image, and also causes the print engine 10*a* to eject ink at predetermined flushing timings. Consequently, at the predetermined flushing timings, the print engine 10*a* repeatedly performs ink flushing to the flushing opening parts 31-1 to 31-M. The ink flushing is performed for discarding ink thickened in the head nozzle.

Further the control unit 81 includes an ejection timing control unit 81*a* that adjusts an ink ejection timing of the print engine 10*a* (here, an ink ejection period in image forming).

When performing the flushing at the m-th time, the ejection timing control unit 81*a* derives an adjustment amount for the ink ejection timing of the print engine 10*a* on the basis of: (a) a number of the ink ejection timings P(m) in a period (i.e. time length L(m)=Tf(m)−Tf(m−1)) from the ink flushing at a previous flushing timing Tf(m−1) to the ink flushing at a current flushing timing Tf(m), (b) a distance S(m) from the flushing opening part 31-*i* for the ink flushing at the previous flushing timing Tf(m−1) to the flushing opening part 31-*j* for the ink flushing at the current flushing timing Tf(m), and (c) a print resolution R.

Here the ejection timing control unit 81*a* derives the adjustment amount for the ink ejection timing of the print engine 10*a* on the basis of a difference (P(m)−Q(m)) between the number of the ink ejection timings P(m) and a reference ejection number Q(m) based on the distance S(m) and the print resolution R (e.g. 600 dpi) (Q(m)=S(m)*R).

In this embodiment, the image forming apparatus 10 further includes a rotary encoder (not shown). The rotary encoder detects rotation of a roller (e.g. the driven roller 4 or the like) that contacts with the transportation belt 2 and rotates with movement of the transportation belt 2, and generates an encoder output signal corresponding to the rotation of the roller. This encoder output signal is a rectangular wave having a period corresponding to a rotation speed of the roller.

The ejection timing control unit 81*a* (a) derives a first correction amount C1 and a second correction amount C2 such that the first correction amount C1 is based on the encoder output signal and the second correction amount C2 is based on the number of the ink ejection timings P(m), the distance S(m), and a print resolution R; and (b) derives the adjustment amount for the ink ejection timing of the print engine 10*a* using the first correction amount C1 and the second correction amount C2.

Specifically, the ejection timing control unit 81*a* derives an ink ejection period U(n), as the ink ejection timings, in accordance with the following formula.

$$U(n)=T0+C1+C2$$

Here T0 is an ink ejection period at an ideal transportation speed (i.e. a theoretical value of the ink ejection period at a specified transportation speed).

Further the first correction amount C1 and the second correction amount C2 are derived in accordance with the following formulas.

$$C1=T(n)-K*T$$

$$C2=(P(m)-Q(m))*T0/Q(m)$$

Here T(n) is a measurement value of an n-th pulse period of the encoder output signal, T is a theoretical value of the pulse period of the encoder output signal, and k is an adjustment coefficient that indicates a tolerance of the roller. It should be noted that T(n) is a value after eccentricity correction. For example, T(n) is set as an average value of the pulse periods of the encoder output signals generated at plural positions in a circumferential direction of the rotary encoder. Thus, the first correction amount C1 is an adjustment amount corresponding to speed fluctuation of the roller.

Figure 5:
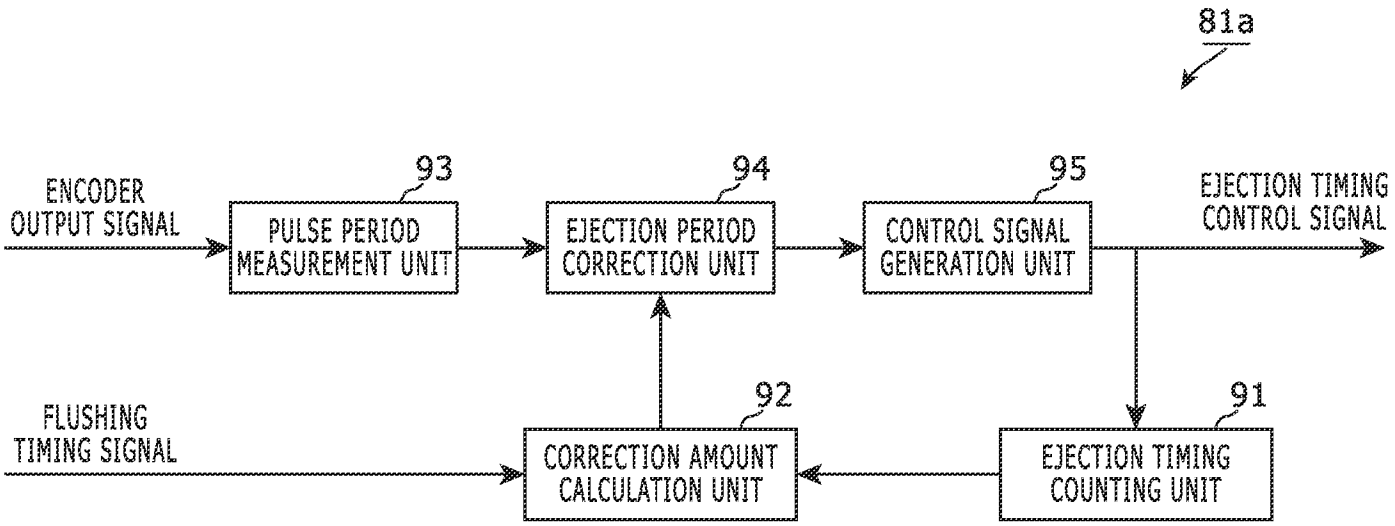
FIG. 5 shows a block diagram that indicates a configuration of an ejection timing control unit 81*a* shown in FIG. 4.

FIG. 5 shows a block diagram that indicates a configuration of the ejection timing control unit 81*a* shown in FIG. 4.

In the ejection timing control unit 81*a*, an ejection timing counting unit 91 counts the ink ejection timing, a correction amount calculation unit 92 (*a*) determines the flushing timings on the basis of a flushing timing signal and determines the number of the ink ejection timings P(m) in a period between flushing timings on the basis of a counting value by the ejection timing counting unit 91, and (b) derives the aforementioned second correction amount C2 on the basis of the ink ejection period theoretical value T0 as a constant, the distance S(m), the print resolution R, and the determined number of the ink ejection timings P(m). Thus the second correction amount C2 is an adjustment amount corresponding to a deviation of the number of the ink ejection timings.

Meanwhile a pulse period measurement unit 93 measures the pulse period T(n) of the encoder output signal, an ejection period correction unit 94 (*a*) derives the aforementioned first correction amount C1 on the basis of the pulse period theoretical value T as a constant, the coefficient k, and the measured pulse period T(n), and (b) corrects the ink ejection period theoretical value T0 with this first correction amount C1 and the derived second correction amount C2, and derives the ejection period U(n). Subsequently, a control signal generation unit 95 generates the ejection timing control signal that specifies ejection timings, on the basis of the derived ejection period U(n).

The inkjet recording units 1*a* to 1*d* determine the ink ejection timings in accordance with this ejection timing control signal, and eject ink at the ink ejection timings when ink should be ejected for a pixel in an image to be printed.

The flushing timing signal is a signal that specifies flushing timings to the inkjet recording units 1*a* to 1*d*, and the control unit 81 generates the flushing timing signal on the basis of a position of the transportation belt 2 determined from a sensor signal generated by a belt sensor 29. The belt sensor 29 is arranged at a predetermined position as shown in FIG. 1, for example, and optically detects an opening part of the transportation belt 2 such as the flushing opening part 31-*i* that passes through this position and thereby detects a rotational position of the transportation belt 2.

Figure 6:
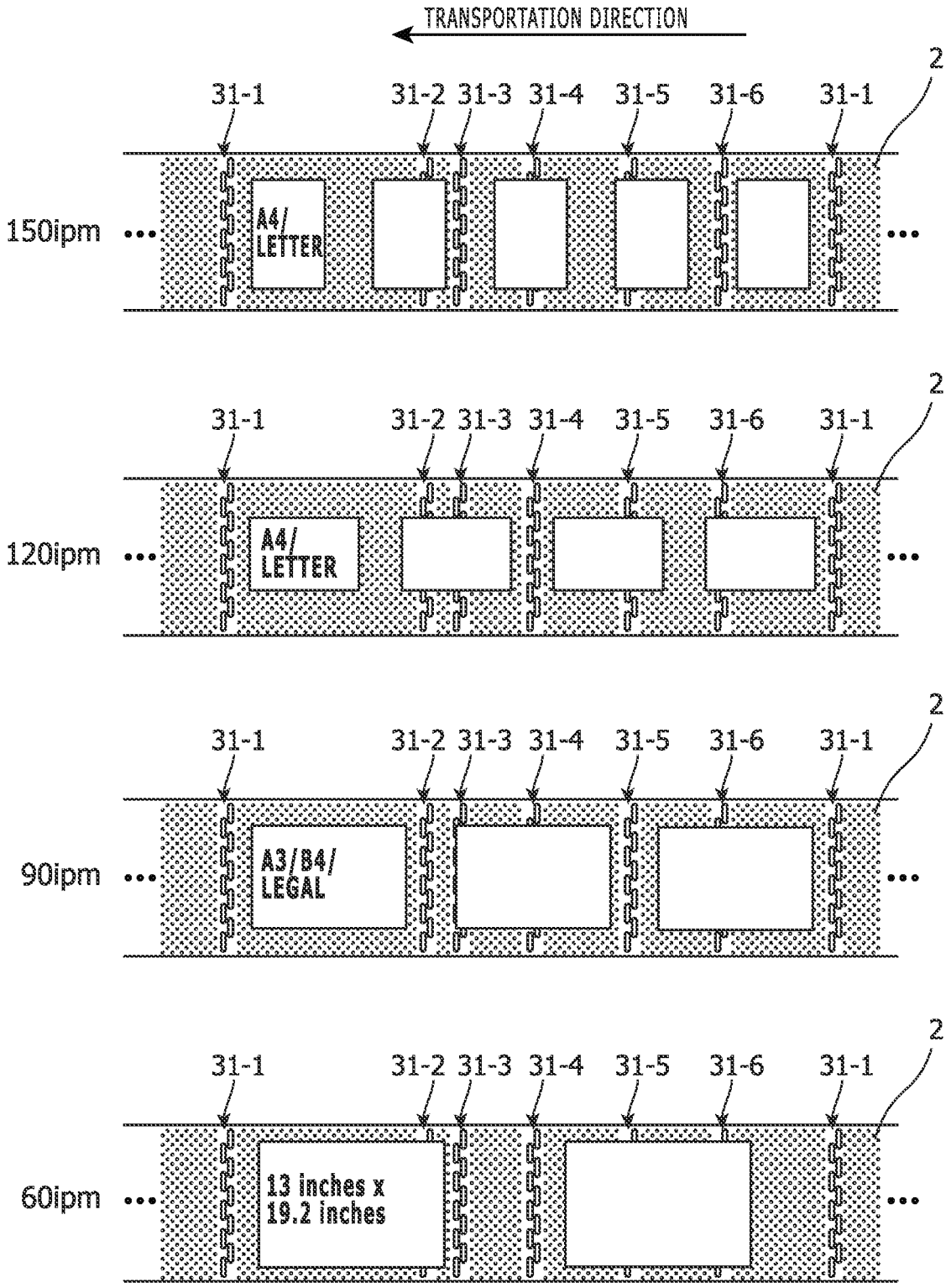
FIG. 6 shows a diagram that explains a flushing timing corresponding to a type of a print sheet.

FIG. 6 shows a diagram that explains a flushing timing corresponding to a type of a print sheet. The aforementioned flushing timing is set at a single or plural phases in a belt period length, for example, as shown in FIG. 6, such that each of the phases becomes in an interval between print sheets and corresponds to a print sheet type.

For example, as shown in FIG. 6, in case of page images with A4R or Letter R size (in case of page images of 150 pages per minute), five print sheets are transported in one belt period, and the flushing is performed at the flushing opening parts 31-1, 31-3 and 31-6. Here a distance between the flushing opening parts 31-1 and 31-3, a distance between the flushing opening parts 31-3 and 31-6, and a distance between the flushing opening parts 31-6 and 31-1 are not identical, i.e. different from each other. Therefore, in this case, the aforementioned distance S(m) changes in accordance with the time number m of the flushing.

For example, as shown in FIG. 6, in case of page images with A4 or Letter size (in case of page images of 120 pages per minute), four print sheets are transported in one belt period, and the flushing is performed at the flushing opening parts 31-1 and 31-4. Here a distance from the flushing opening part 31-1 to the flushing opening part 31-4, and a distance from the flushing opening part 31-4 to the flushing opening part 31-1 are identical to each other. Therefore, in this case, the aforementioned distance S(m) does not change in accordance with the time number m of the flushing, and is therefore constant.

For example, as shown in FIG. 6, in case of page images with A3, B4 or Legal size (in case of page images of 90 pages per minute), three print sheets are transported in one belt period, and the flushing is performed at the flushing opening parts 31-1, 31-2, and 31-5. Here a distance between the flushing opening parts 31-1 and 31-2, a distance between the flushing opening parts 31-2 and 31-5, and a distance between the flushing opening parts 31-5 and 31-1 are identical to each other.

For example, as shown in FIG. 6, in case of page images with 13 inch by 19.2 inch size (in case of page images of 60 pages per minute), two print sheets are transported in one belt period, and the flushing is performed at the flushing opening parts 31-1 and 31-4.

Figure 7:
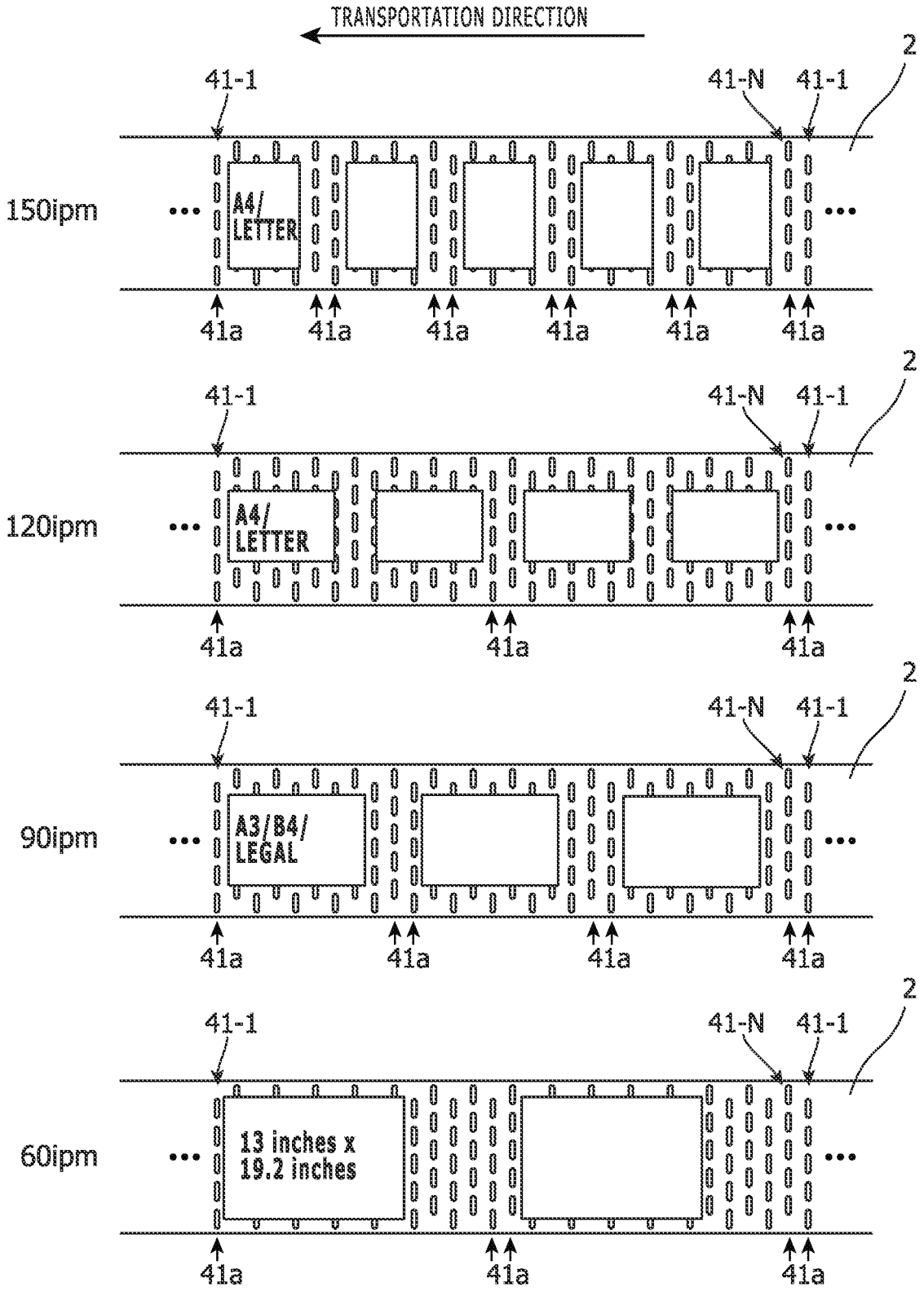
FIG. 7 shows a diagram that indicates another example of the transportation belt 2 shown in FIG. 1.

FIG. 7 shows a diagram that indicates another example of the transportation belt 2 shown in FIG. 1. For example, as shown in FIG. 7, flushing opening parts 41-1 to 41-N in the transportation belt 2 may be arranged with a regular interval along a rotational direction (i.e. secondary scanning direction) of the belt 2, and may be also used as the sheet suction holes. In this case, for example, as shown in FIG. 7, flushing opening parts 41*a* are selected with a regular interval among the flushing opening parts 41-1 to 41-N, and used for the flushing.

The following part explains a behavior of the image forming apparatus 10.

When printing an image, the control unit 81 controls the print engine 10*a* and causes the print engine 10*a* to eject ink from nozzles of the inkjet recording units 1*a* to 1*d* onto a print sheet at ink ejection timings of the ink to be ejected for pixels in the image. The ink ejection timing repeatedly comes with the aforementioned ejection period, and ink is ejected for a pixel at an ink ejection timing corresponding to the pixel.

Further the control unit 81 determines flushing timings on the basis of a print sheet type and the like, controls the print engine 10*a*, and causes the print engine 10*a* to eject ink from nozzles of the inkjet recording units 1*a* to 1*d* toward the flushing opening parts 31-*i* or 41-*i* at the ink ejection timings.

Subsequently, the ejection timing control unit 81*a* counts up the number of the ink ejection timings P(m) when printing, and as mentioned, repeatedly derives the first and second correction amounts C1 and C2, updates the ejection period every time when deriving the first and/or second correction amounts C1 and/or C2, and adjusts the ink ejection timings.

As mentioned, in Embodiment 1, the transportation belt 2 includes the flushing opening part 31-*i* or 41-*i*. The print engine 10*a* repeatedly performs ink flushing to the flushing opening part 31-*i* or 41-*i* at a predetermined timings. Further the ejection timing control unit 81*a* derives an adjustment amount (the aforementioned second correction amount C2) for the ink ejection timing of the print engine 10*a* on the basis of: a number of the ink ejection timings P(m) in a period from a previous ((m−1)-th) flushing time to a current (m-th) flushing time, a distance S(m) from the flushing opening part 31-*i* or 41-*i* for the flushing at the previous flushing time to the flushing opening part 31-*j* or 41-*j* for the flushing at the current flushing time, and a print resolution R.

Thus, the ink ejection timings are adjusted on the basis of timings of the ink flushing using the flushing opening parts 31-*i* or 41-*i* formed in the transportation belt 2, and therefore, as mentioned, even if speed fluctuation occurs of the transportation belt 2 due to the driving system from the motor or the roller to the transportation belt 2, an error due to this speed fluctuation is detected as the second correction amount C2 and the ink ejection timings are properly adjusted. Consequently an image is formed with a favorable image quality at a relatively low cost, without using high resolution encoder or the like.

Embodiment 2

In Embodiment 2, the ejection timing control unit 81*a* derives the adjustment amount (the second correction amount C2) so as to be an integral multiplication of a clock period of a predetermined clock signal, stores a rounding error W(m) that occurs when deriving the adjustment amount as the integral multiplication, and derives the adjustment amount at a next adjustment timing (next flushing timing) in consideration with the stored rounding error W(m).

Specifically, in accordance with the following formulas, the ejection timing control unit 81*a* derives the second correction amount C2 using the rounding error W(m−1) of the previous flushing timing, and derives and stores the rounding error W(m) of the current flushing timing.

$$C2=\mathrm{CLK}*\mathrm{INT}((C20+W(m-1))/\mathrm{CLK})$$

$$\text{Here, } C20=(P(m)-Q(m))*T0/Q(m).$$

$$W(m)=(C20+W(m-1))-C2$$

Here W(m) is a rounding error at the current flushing, CLK is a clock period of a clock signal for a control signal that specifies the ink ejection timings, and INT(X) indicates the integer part of X. If X is less than 1, then INT(X) gets 0.

If a value of (C20+W(m−1)) is less than the clock period, then C2 and W(m) may be calculated as C2=0 and W(m)=C20+W(m−1), and otherwise, if not, then C2 and W(m) may be calculated as C2=C20+W(m−1) and W(m)=0 or W(m)=C2−CLK*INT((C20+W(m−1))/CLK). An initial value W(0) of the rounding error is set as 0.

T0 is sufficiently longer than the clock period, and a fraction does not occur when T0 is converted to a clock number. For example, if the clock frequency is 100 MHz (i.e. the clock period is 10 ns) and T0 is 55 micro seconds, then T0 is expressed as 5500 clocks. Further, as mentioned, C2 is set as a multiple of the clock period CLK, and even though a fraction thereby occurs when generating the control signal that specifies the ink ejection timings in synchronization with the clock signal, the fraction is considered at a next adjustment timing, and consequently if the second correction amount C2 is small, the adjustment on the ink ejection timings is performed in consideration with the second correction amount C2.

Other parts of the configuration and behaviors of the image forming apparatus in Embodiment 2 are identical or similar to those in Embodiment 1, and therefore not explained here.

As mentioned, in Embodiment 2, even if a value of the second correction amount C2 is small, the ink ejection timings are properly adjusted.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned Embodiment 1 or 2, the updating of the ejection period U may be performed at the flushing timing (i.e. at a timing in outside of the page image). In this case, the page image is not affected by fluctuation of the ejection period U.

Further, in Embodiment 1 or 2, the ejection period U may be derived as a clock number.

What is claimed is:

1. An image forming apparatus, comprising:

a transportation belt configured to transport a print sheet;

a print engine configured to eject ink onto the print sheet; and an ejection timing control unit configured to adjust an ink ejection timing of the print engine;

wherein the transportation belt comprises a flushing opening part;

the print engine repeatedly performs ink flushing to the flushing opening part at predetermined timings; and the ejection timing control unit derives an adjustment amount for the ink ejection timing of the print engine on the basis of: a number of the ink ejection timings in a period from a previous flushing time to a current flushing time, a distance from the flushing opening part for the flushing at the previous flushing time to the flushing opening part for the flushing at the current flushing time, and a print resolution.

2. The image forming apparatus according to claim 1, wherein the ejection timing control unit derives the adjustment amount on the basis of a difference between (a) the number of the ink ejection timings and (b) a reference ejection number based on the distance and the print resolution.

3. The image forming apparatus according to claim 1, further comprising:

a roller configured to contact the transportation belt and rotate with movement of the transportation belt; and a rotary encoder configured to detect rotation of the roller and generate an encoder output signal corresponding to the rotation of the roller;

wherein the ejection timing control unit (a) derives a first correction amount and a second correction amount such that the first correction amount is based on the encoder output signal and the second correction amount is based on the number of the ink ejection timings, the distance, and a print resolution; and (b) derives the adjustment amount using the first correction amount and the second correction amount.

4. The image forming apparatus according to claim 1, wherein the ejection timing control unit derives the adjustment amount so as to be an integral multiplication of a clock period of a predetermined clock signal, stores a rounding error that occurs when deriving the adjustment amount so as to be the integral multiplication, and derives the adjustment amount at a next adjustment timing in consideration with the stored rounding error.

* * * * *